US008141878B2

(12) United States Patent
Kuyl

(10) Patent No.: US 8,141,878 B2
(45) Date of Patent: Mar. 27, 2012

(54) ROLLING TARGET DEVICE

(76) Inventor: Marinus D. Kuyl, Beaverton, OR (US)

( * ) Notice: Subject to any disclaimer, the term of this patent is extended or adjusted under 35 U.S.C. 154(b) by 197 days.

(21) Appl. No.: 12/662,871

(22) Filed: May 7, 2010

(65) Prior Publication Data

US 2011/0068538 A1 Mar. 24, 2011

Related U.S. Application Data

(60) Provisional application No. 61/272,439, filed on Sep. 24, 2009.

(51) Int. Cl.
*F41J 3/00* (2006.01)

(52) U.S. Cl. ..... 273/403

(58) Field of Classification Search ..... 273/403
See application file for complete search history.

(56) References Cited

U.S. PATENT DOCUMENTS

| | | | | | |
|---|---|---|---|---|---|
| 398,186 | A * | 2/1889 | Rehfuss | 273/404 |
| 1,981,293 | A | 11/1934 | Varrelman | |
| 2,048,155 | A * | 7/1936 | Armantrout | 273/407 |
| 2,466,686 | A * | 4/1949 | Connelly | 226/43 |
| 3,893,336 | A * | 7/1975 | Tucker | 73/167 |
| 4,549,917 | A * | 10/1985 | Jensen, Jr. | 156/108 |
| 4,583,744 | A | 4/1986 | Tolliver et al. | |
| 5,031,920 | A * | 7/1991 | Poirier | 273/371 |
| 5,169,157 | A | 12/1992 | Salmon | |
| 5,829,753 | A | 11/1998 | Wiser | |
| 6,123,796 | A * | 9/2000 | Kathmann et al. | 156/249 |
| 6,257,584 | B1 * | 7/2001 | Nasuti | 273/407 |
| 6,543,778 | B2 * | 4/2003 | Baker | 273/407 |
| 7,784,794 | B2 * | 8/2010 | Sitton | 273/348 |
| 7,834,300 | B2 * | 11/2010 | Zemany et al. | 244/3.15 |
| 2006/0050929 | A1 * | 3/2006 | Rast et al. | 382/103 |
| 2008/0211190 | A1 | 9/2008 | Smith | |

* cited by examiner

*Primary Examiner* — Alvin Hunter
*Assistant Examiner* — Dolores Collins
(74) *Attorney, Agent, or Firm* — Richard C. Litman

(57) ABSTRACT

The rolling target device includes a base and an upstanding target window frame disposed at one end of the base. The target window frame has an opening for displaying a printed target. The opposite end of the base includes a clamp for holding a roll of paper. A selective printing assembly is disposed in the base and operatively connected to a paper feeding assembly such that discreet portions of the paper web may be printed with a desired target design and fed through the target window to expose the target design at the cutout. The printing assembly includes interchangeable printing stamps of various designs that may be selectively attached to a printing platen. The paper roll may be paper towels or toilet paper.

20 Claims, 11 Drawing Sheets

ROLLING TARGET DEVICE

CROSS-REFERENCE TO RELATED APPLICATION

This application claims the benefit of U.S. Provisional Patent Application Ser. No. 61/272,439, filed Sep. 24, 2009.

1. FIELD OF THE INVENTION

The present invention relates to target shooting accessories, and more specifically, to an economical, automatic rolling target device utilizing common household paper rolls, such as paper towels and toilet paper.

2. DESCRIPTION OF THE RELATED ART

For anyone who is at all serious about firearms or other projectile weapons, it behooves one to practice in order to improve one's accuracy. Several avenues are available to practice one's skills. One is to use a shooting range facility, both indoor and outdoor. Either allows the user to rent firearms and ammunition as well the time and number of target sheets for the session. The shooting range is a safe environment for the user, but the costs can quickly add up.

Another alternative is the use of home target devices, which may range from a simple hanging target to an automatic scrolling target device. With respect to scrolling target devices, these may be easily setup at a safe location remote from potential passersby for the user to practice targeting and shooting. While the portability and on-demand use of such devices may be convenient, they still pose a substantial investment for the user in addition to the device itself due to the specialized paper that must be used therein. The specialized paper is typically heavyweight paper with preprinted targets thereon, which limits the versatility of the device when the user desires to practice on different shaped or designed targets. As a result, the user must purchase several rolls or sheets with the desired target pattern. In light of the above, it would be a benefit in the art to provide a user with a target device that is economical and offer a variety of alternatives targets for the user.

Thus, a rolling target device solving the aforementioned problems is desired.

SUMMARY OF THE INVENTION

The rolling target device includes a base and an upstanding target window frame disposed at one end of the base. The target window frame has an opening for displaying a printed target. The opposite end of the base includes a clamp for holding a roll of paper. A selective printing assembly is disposed in the base and operatively connected to a paper feeding assembly such that discreet portions of the paper web may be printed with a desired target design and fed through the target window to expose the target design at the cutout. The printing assembly includes interchangeable printing stamps of various designs that may be selectively attached to a printing platen. The paper roll may be paper towels or toilet paper. A control means controls feeding and printing of the paper web.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
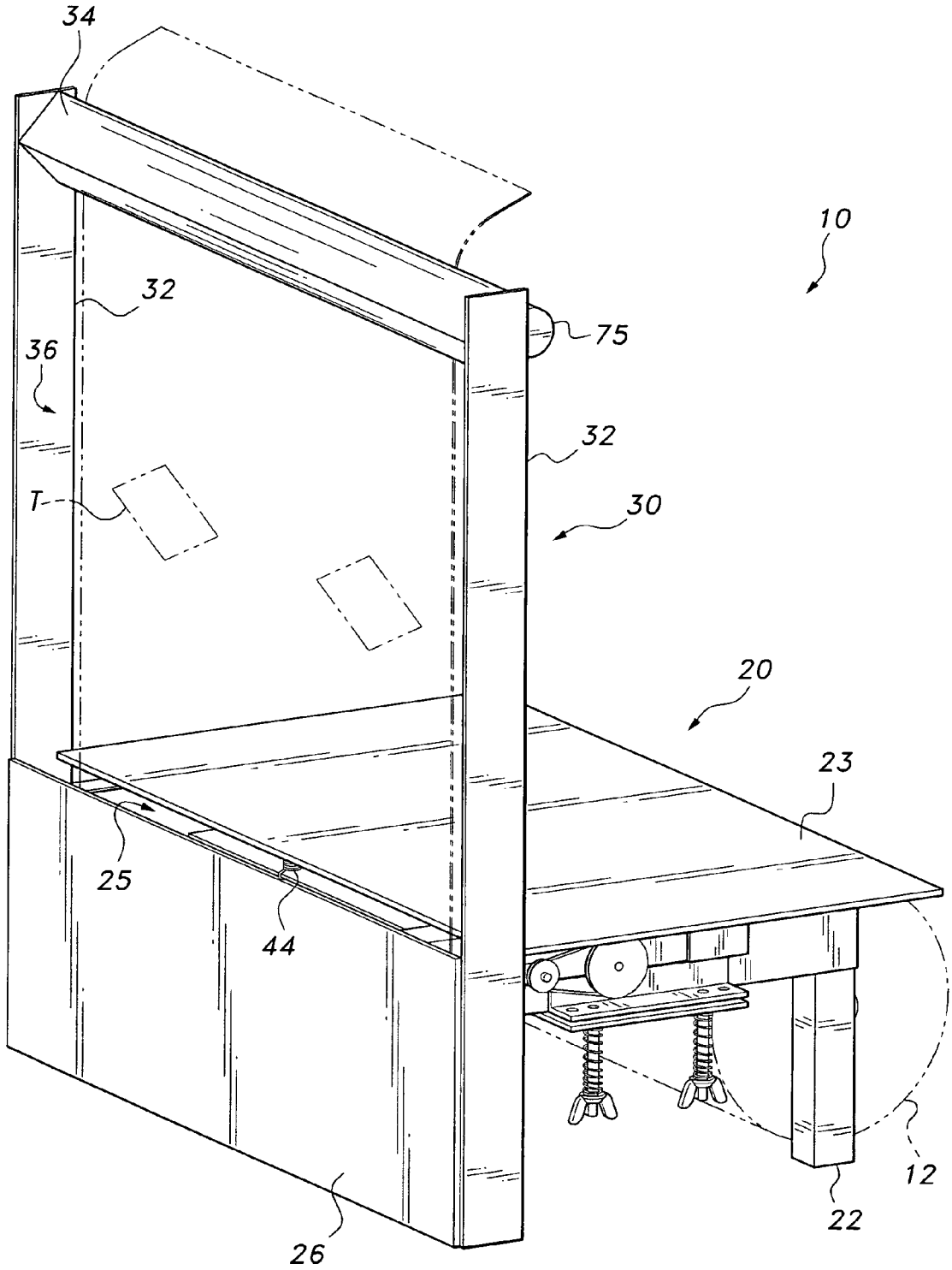
FIG. 1 is an environmental, perspective view of a rolling target device according to the present invention.
Figure 2:
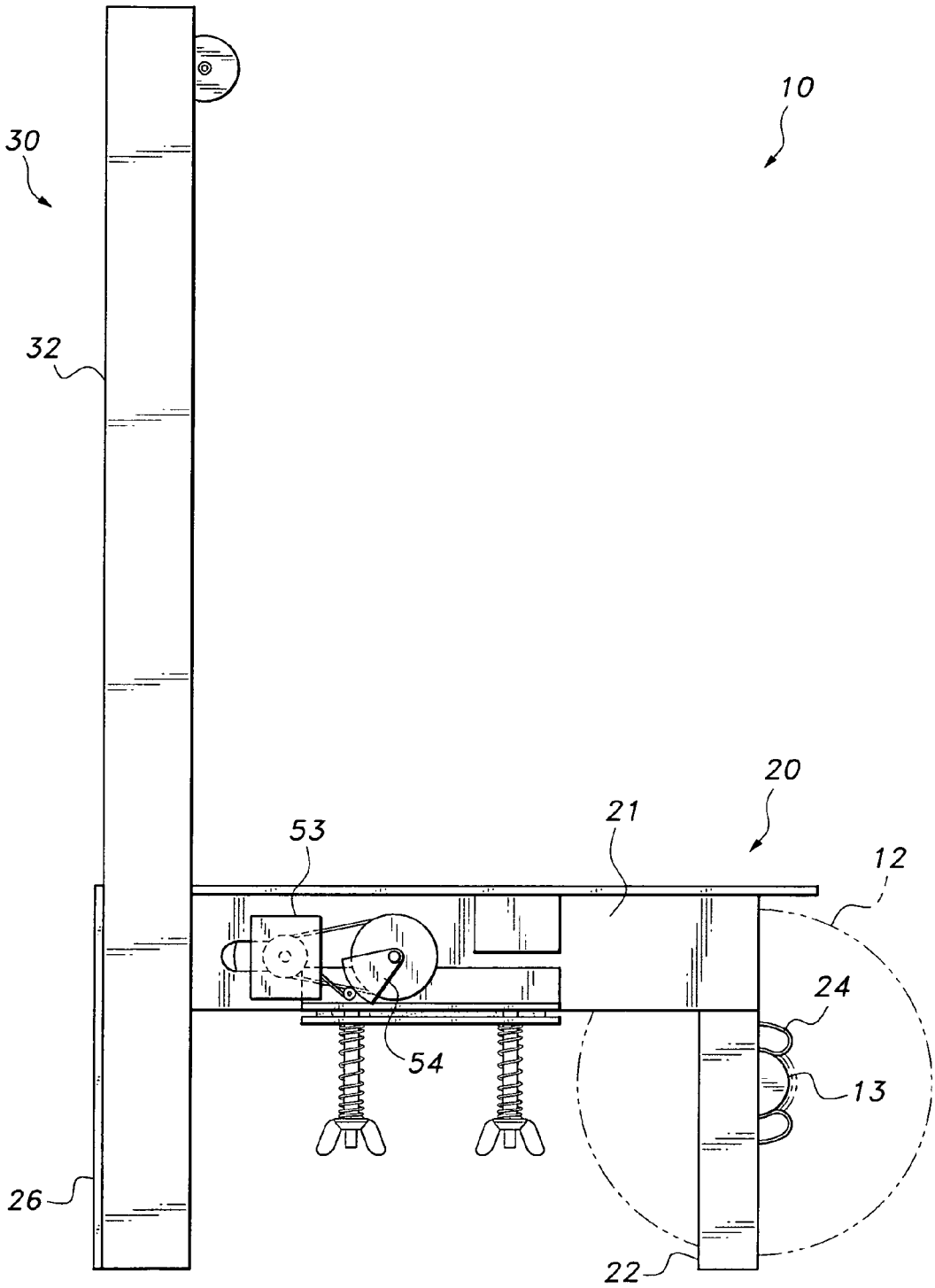
FIG. 2 is a left side view of the rolling target device according to the present invention.
Figure 3:
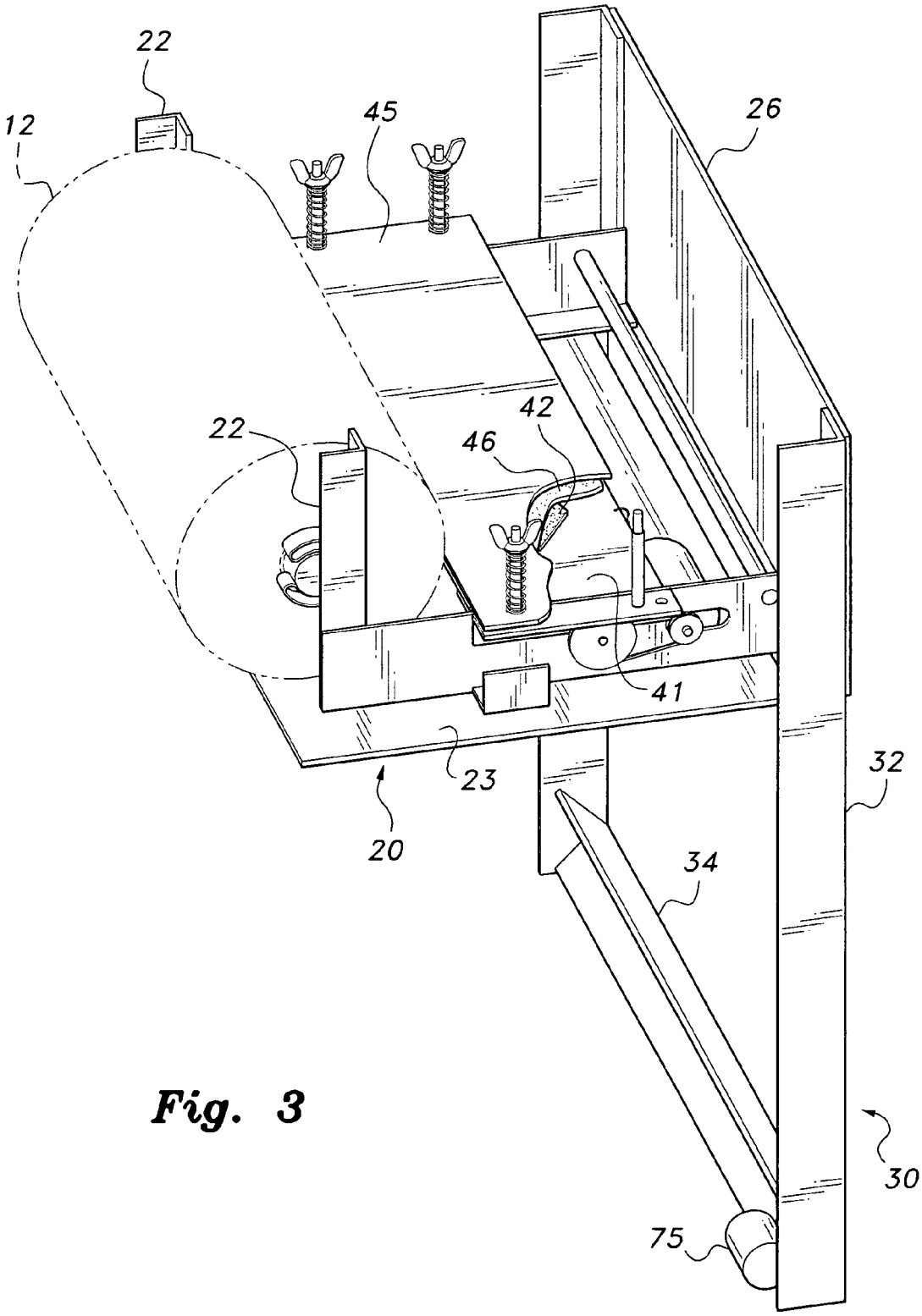
FIG. 3 is a perspective view of the bottom of the rolling target device according to the present invention.
Figure 4:
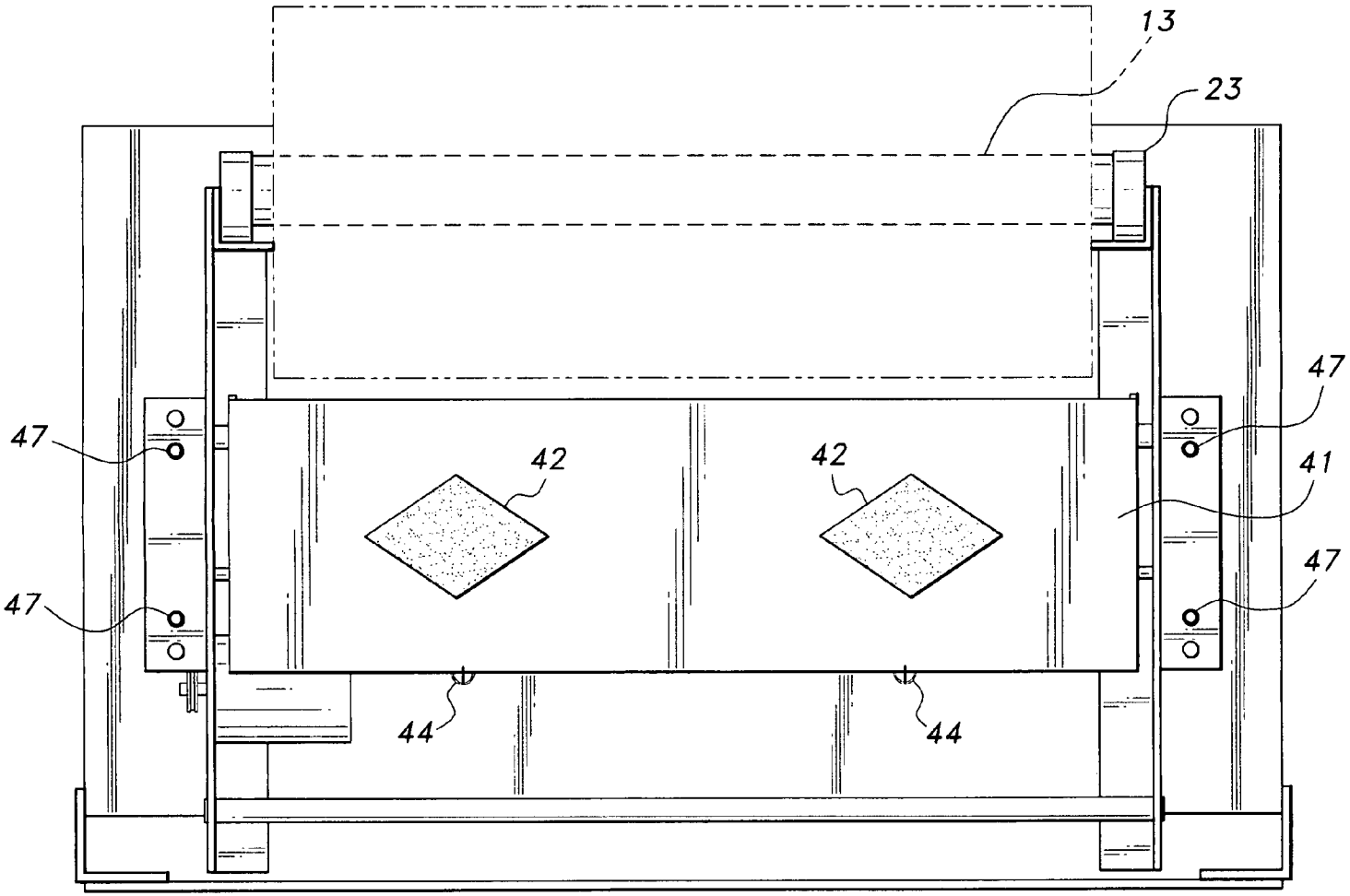
FIG. 4 is a bottom view of the rolling target device according to the present invention without the print tray.

The present invention relates to a rolling target device, a first embodiment of which is generally referred to by reference number 10, utilizing household paper rolls as the printing media for a target display. As shown in FIGS. 1 and 2, the rolling target device 10 includes a base 20 and a target window frame 30 attached to one end of the base 20. The opposite end of the base 20 includes spaced apart clamps 24 adapted to hold a paper supply roll 12. A selective target printing assembly 40 may be disposed in the base 20 such that in operation, the web W of material from the supply roll 12 is positively fed through the printing assembly 40 and threaded through the target window frame 30 to thereby display a printed target T.

The base 20 may be formed as a substantially rectangular, tabletop frame or platform supported by legs 22 at one end and a barrier wall 26 at the other end. The barrier wall 26 serves as a protective cover for the underpinnings of the printing assembly 40 from flying projectiles. A rectangular top 23 lies atop the legs 22 and extends towards the barrier wall 26 without meeting the wall 26 to form a gap 25. The gap 25 permits the web W of material from the supply roll 12 to be threaded through to expose the printed target T. As previously noted, the other end of the base 20 includes a pair of spaced apart clamps 24 adapted to hold the supply roll 12. In the exemplary embodiment, the clamps 24 may be biased and formed by strips of sheet metal forming a C-clamp with each clamp 24 disposed on each leg 22. A roll bar 13 is mounted through the supply roll 12 and the clamps 24 hold the outer ends of the roll bar 13.

The target window frame 30 may be a substantially rectangular framework having upstanding members or legs 32 fixedly attached to lateral sides of the base 20. A cross member or cover 34 disposed at the top interconnects the legs 32 to form the rectangular framework. By this configuration, the target window frame 30 forms a window 36 at which the printed target T may be displayed. The cover 34 protects a feeding assembly 70 disposed behind the cover 34.

To print various target designs, the rolling target device 10 includes the selective target printing assembly 40 disposed underneath the base 20. As shown in FIGS. 2-4, 6A and 6B, the target printing assembly 40 includes a selectively actuated printing platen 41 pivotable about pivot 43. At least one spring 44 is attached to the printing platen 41 at a distal end from the pivot 43 to maintain the printing platen 41 in the upraised or ready position shown in FIG. 6A. At least one target stamp 42 may be detachably mounted to the printing platen 41. Although the drawings show diamond-shaped target stamps 42 and targets, the target stamps 42 are interchangeable and may come in a variety of different patterns, shapes and sizes, e.g. crosses, concentric circles, etc., as desired by the user.

The target printing platen 41 is configured to act against an inkpad 46 disposed on a support platen 45 to thereby print the desired target pattern on the web W therebetween. The support platen 45 is detachably mounted to the base 20 via mounting bolts 47 so that the inkpad 46 may be recharged with relative ease. Due, in part, by the relative delicate nature of the supply roll 12 being paper towels or toilet paper, the support platen 45 is attached to the base 20 in a spring-loaded manner via springs 48 on each of the mounting bolts 47. In this way, the support platen 45 absorbs impact forces from the printing platen 41 and relieves some of the stresses experienced by the web W therebetween. The bias or tension may be adjusted by the wingnuts 49 on each of the mounting bolts 47. In addition or as an alternative, the pivot end of the printing platen 41 may also include springs and slots to allow limited vertical movement of the printing platen 41 during the printing process as indicated by arrow 14. This will also help relieve some tension in the web W during the printing process.

Figure 6A:
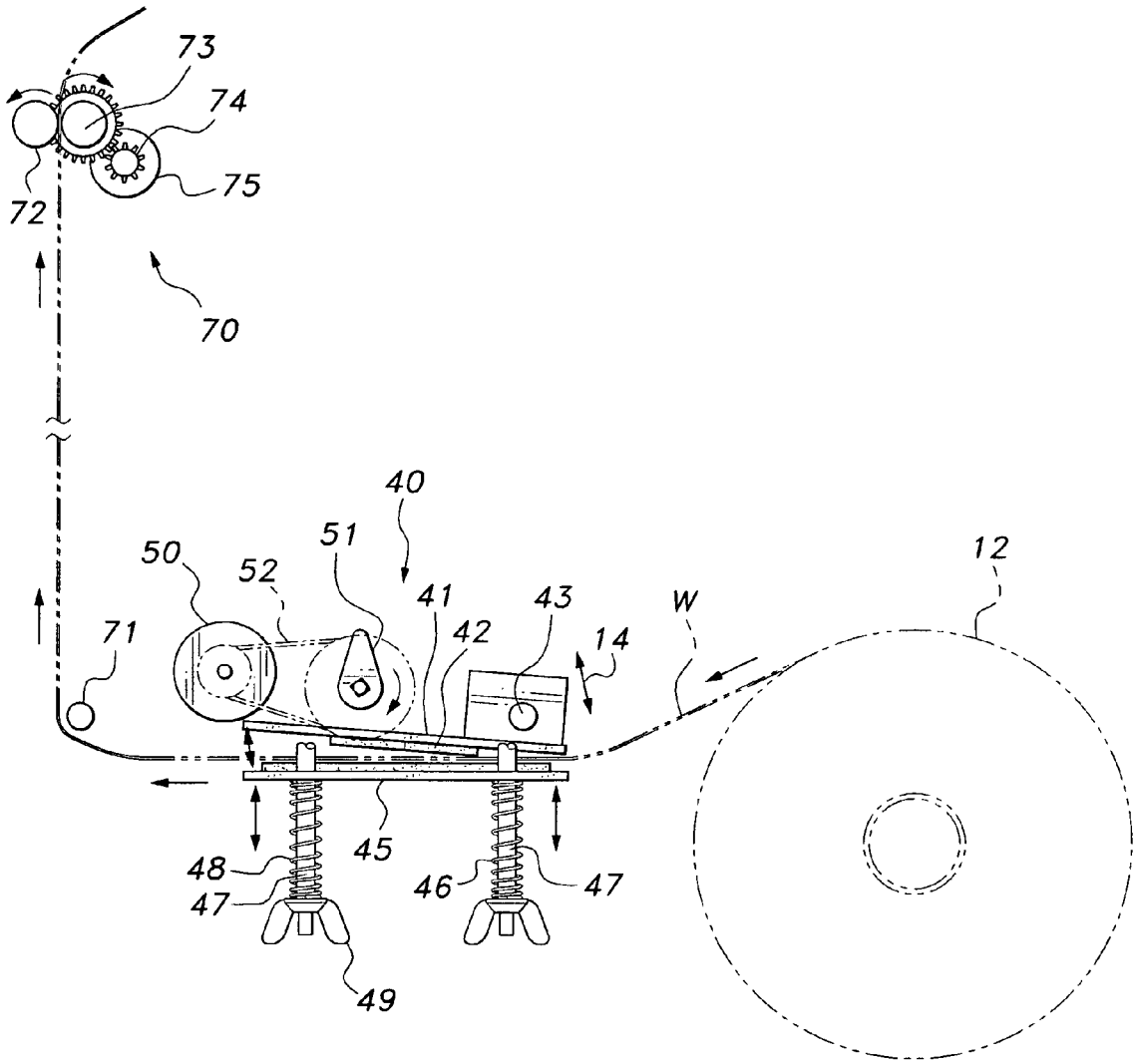
FIG. 6A is a schematic view of the printing operation of the rolling target device according to the present invention.
Figure 6B:
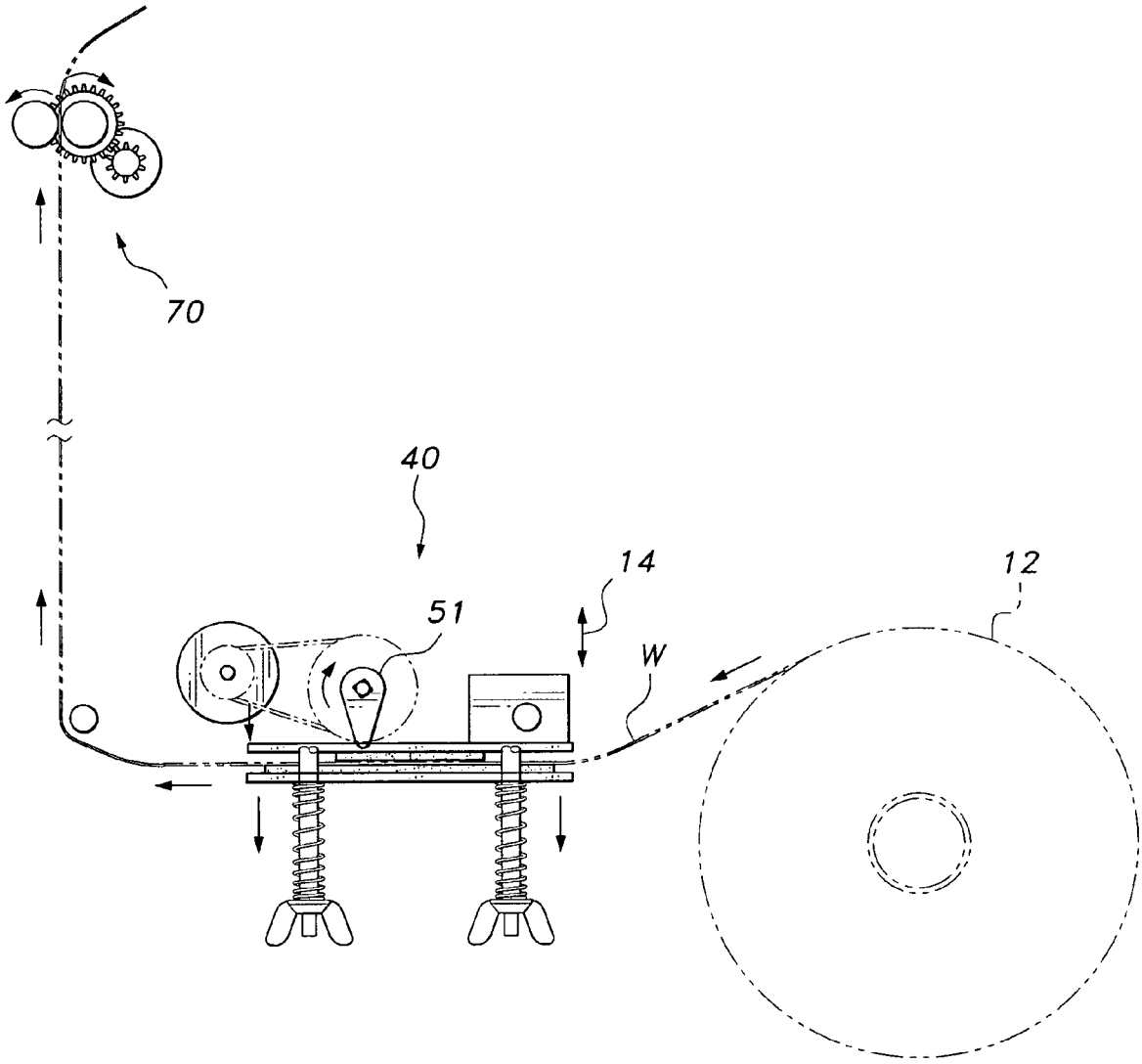
FIG. 6B is a schematic view of the final printing operation of the rolling target device according to the present invention.

To actuate the printing platen 41, the target printing assembly 40 includes a motor 50 operatively attached to a printing cam 51 via a drive belt 52. Upon activation of the motor 50, the motor 50 rotates the printing cam 51 such that the cam 51 impacts the upper side of the printing platen 41 to print a target on web W during each full rotation or cycle of the printing cam 51. As shown in FIG. 6A, this drawing shows the initial position of the printing cam 51 somewhere on or between the 9 o'clock and 12 o'clock positions. In FIG. 6B, the printing cam 51 has rotated to the 6 o'clock position forcing the printing platen 41 down to impress and print the target on the web W.

To ensure that the printing platen 41 is in the up position during each cycle, a microswitch 53 is operatively attached to the motor 50. The printing cam 51 includes a microswitch cam 54 that selectively trips the microswitch 53 during a portion of the printing cam 51 cycle to stop the motor 50 when the printing platen 41 has returned to the up position.

The web W is positively fed through the rolling target device 10 by a web feeding assembly 70. The web feeding assembly 70 includes a feed motor 75 disposed behind the protective cover 34. The web W is wound around an idle roller 71, through the gap 25, and through a pair of feed rollers 72, 73. The motor 75 includes a toothed pinion or gear 74 acting in conjunction with the gear on the feed roller 73 to positively and selectively feed the web W out.

Figure 5:
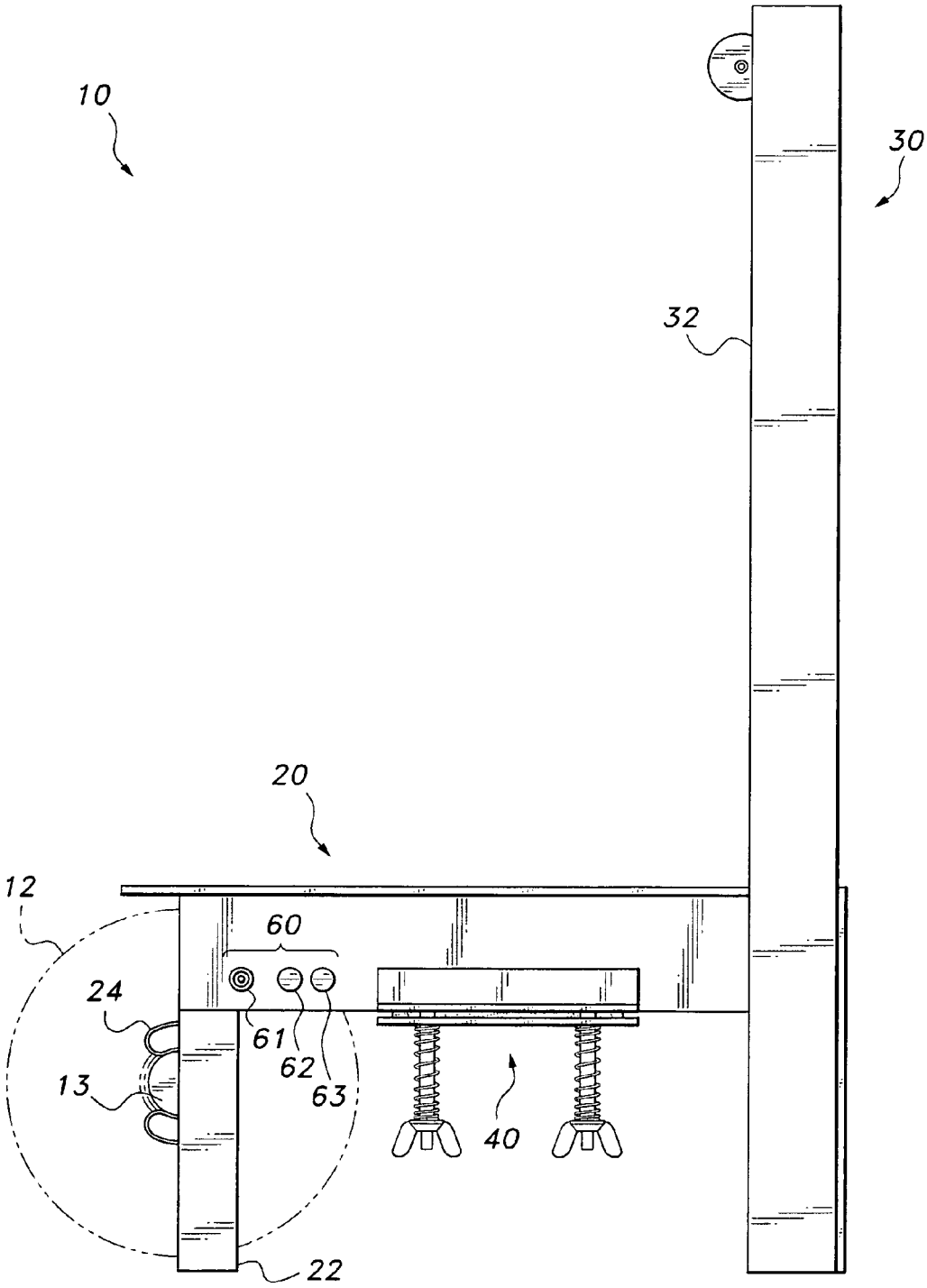
FIG. 5 is a right side view of the rolling target device according to the present invention.

The operation of the rolling target device 10 is controlled by a control means 60 disposed on the opposite side of the base 20. As shown in FIG. 5, the control means 60 includes a power supply socket 61 adapted to be attached to an electric power source. Of course other kinds of power supplies may be utilized instead. The control means 60 also includes a feed switch 62 and a printing switch 63 for respective selective operation of feeding the web W and printing. As an alternative, both the feed switch 60 and the printing switch 62 may be operated from a remote location by a remote unit physically attached to the rolling target device 10 or a cordless using radio or infra red signals as an example. As a further alternative, the control means 60 may include a digital readout or LCD to display pertinent information and/or touchscreen control buttons.

The following describes how to use the rolling target device 10. For preparation, the support platen 45 is detached from the base 20. The inkpad 46 may be recharged with colored ink as needed. The user mounts target stamp(s) 42 of a desired pattern to the printing platen 41. A supply roll 12 of paper towels or toilet paper is mounted to the spring clamps 24, and a web W therefrom is threaded through the idle roller 71, the gap 25 and the feed rollers 72, 73. The support platen 45 is then mounted to the base 20, and the bias thereof is adjusted by the wingnuts 49. Once assembled and connected to power, the user operates the printing switch 63 to print a target pattern onto the web W. The user then operates the feed switch 62 until the target T is displayed through the window 36. The user may practice shooting at this time. Once finished, the feed switch 62 is activated to feed out the spent target T to be discarded. Another target may be printed by activating the printing switch 63. If it is desired to practice on a different target pattern, the support platen 45 may be removed to replace the target stamps 42 with the desired different pattern.

An alternative embodiment of the rolling target device, generally designated as 100 in the drawings, is shown in FIGS. 7-10. In this embodiment, the rolling target device 100 is substantially similar in function and form to the rolling target device 10 shown in the previous figures with the inclusion of additional convenience and operational features.

Figure 7:
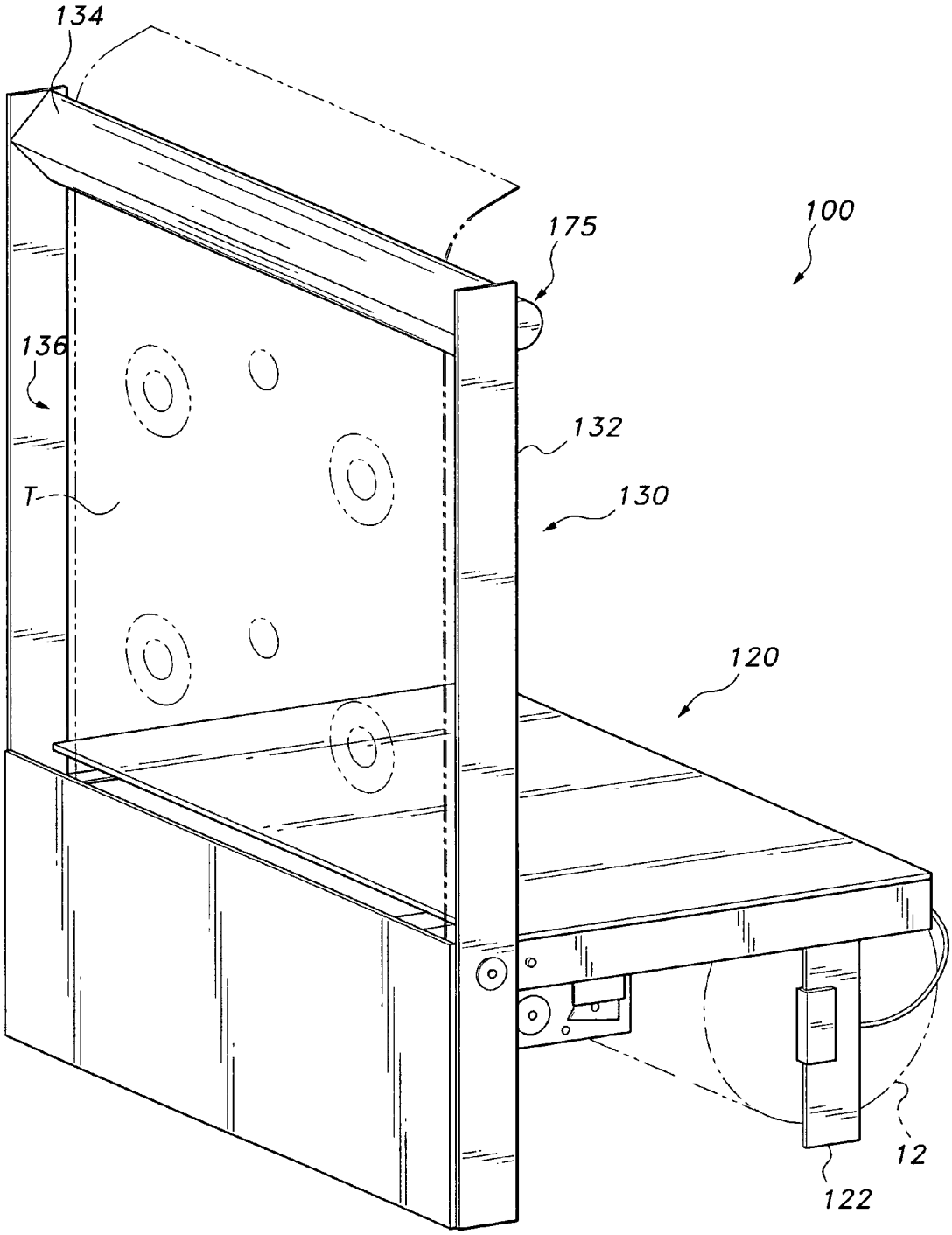
FIG. 7 is an environmental perspective view of an alternative embodiment of a rolling target device according to the present invention.
Figure 8:
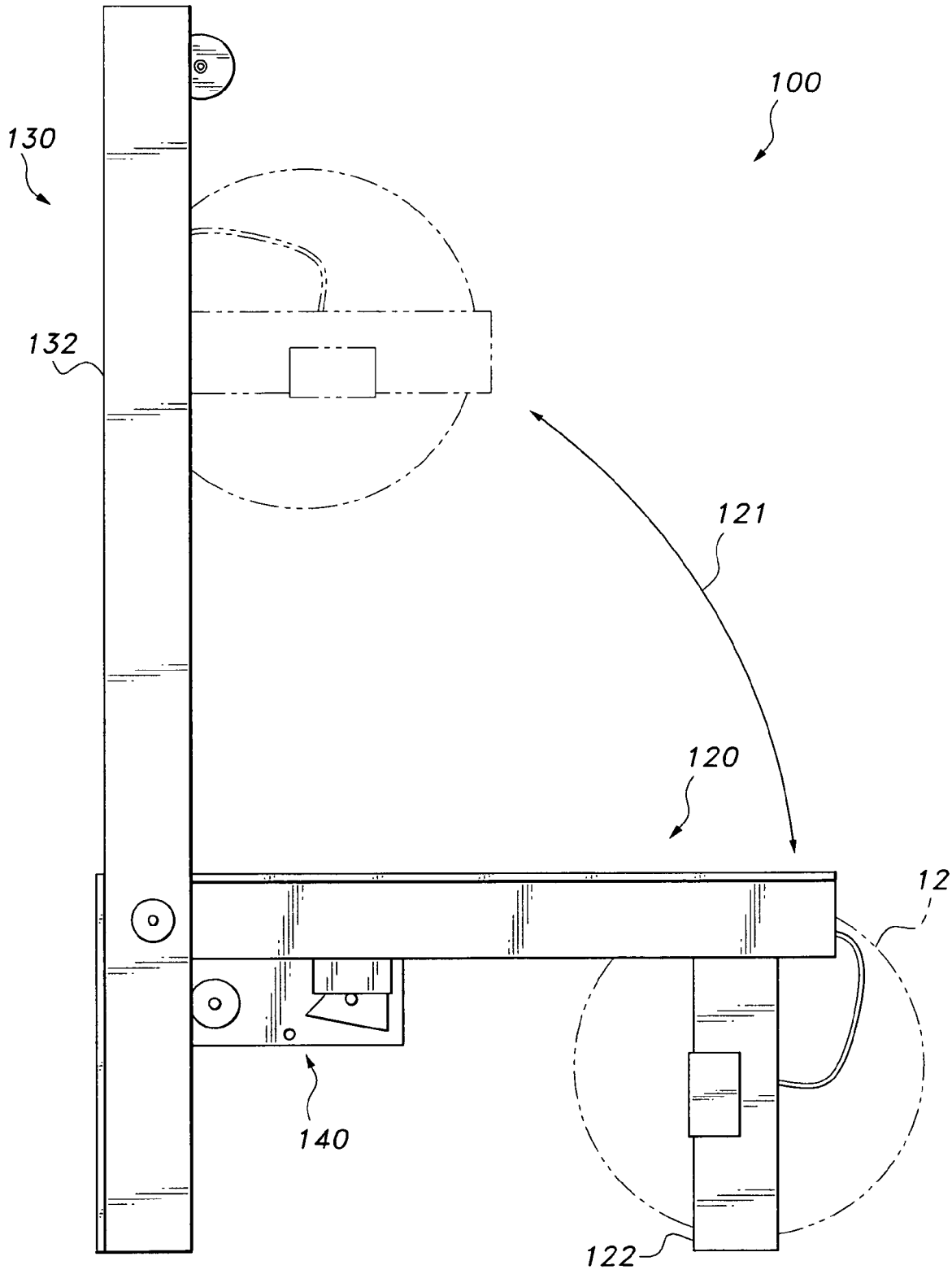
FIG. 8 is a side view of the rolling target device of FIG. 7.

As shown in FIGS. 7 and 8, the rolling target device 100 includes a target window frame 130 attached to a pivotable base 120. A printing assembly 140 is detachably mounted to one of the upstanding members or legs 132 in the rectangular target window frame 130 to print the desired printed target T. The target window frame 130 is substantially similar to the window frame 30 in that the target window frame 130 includes a substantially rectangular framework having legs 132, a cross member or cover 134 and a window 136 defined therebetween through which the printed target T may be displayed. A motor 175 is disposed behind the cover 134 in operative connection with a roller to hold and feed printed targets T.

The base 120 is pivotally mounted to the legs 132 so that the base 120 may be folded into the target window frame 130 as indicated by the arrow 121. This permits the rolling target device 100 to be folded into a more compact form for easier transport and storage. The base 120 may be formed as a substantially rectangular, tabletop frame or platform supported by legs 122. Although not shown in FIGS. 7, 8 and 10, each of the legs 122 include a clamp adapted to hold the supply roll 12. These clamps may be similar to the clamps 24 shown in FIGS. 2 and 3.

Figure 9:
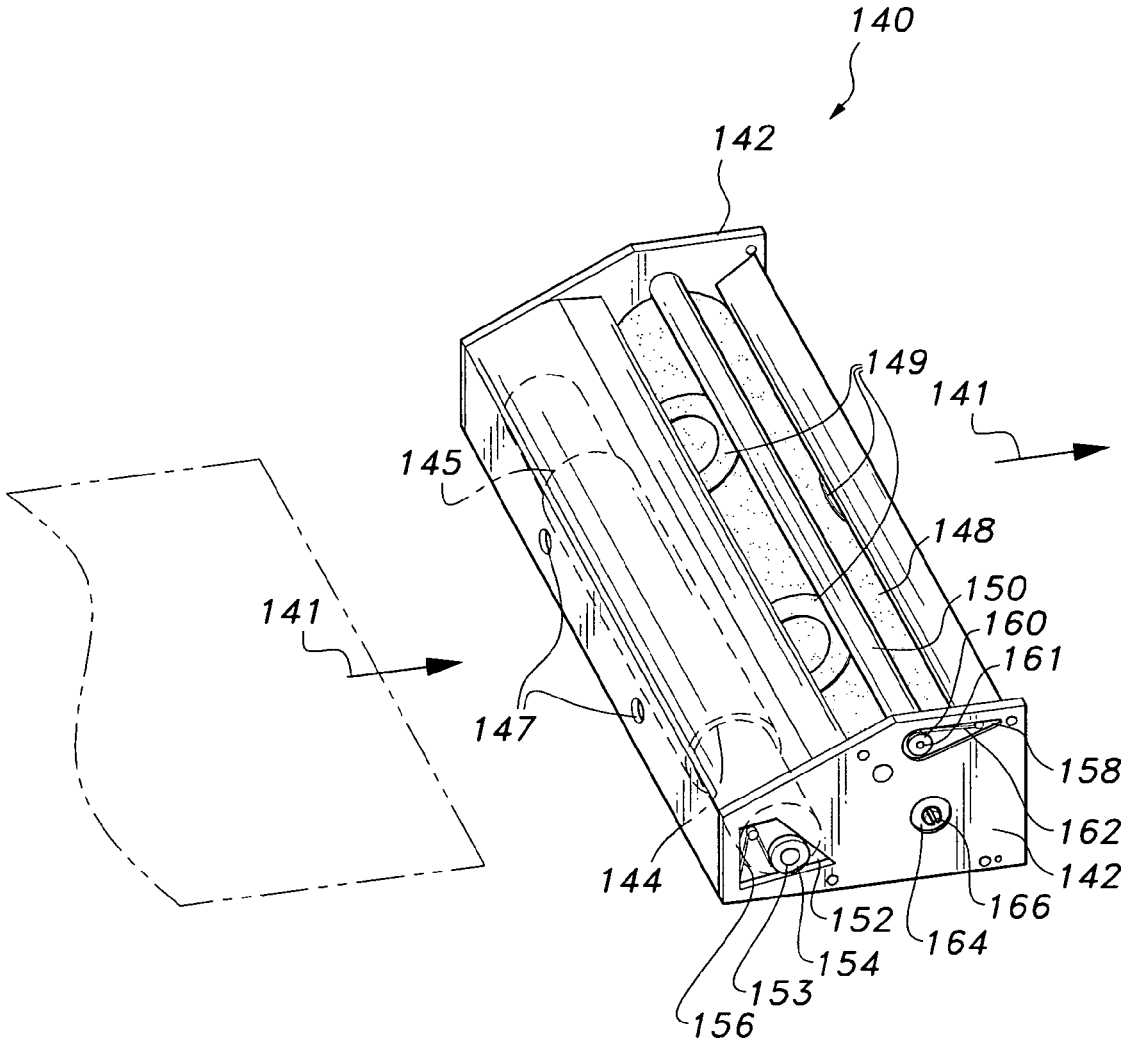
FIG. 9 is a perspective view of the removable printing cartridge for the rolling target device of FIG. 7.

The printing assembly 140 selectively prints a desired target pattern on a web from the supply roll 12 to obtain the printed target T. Unlike the printing assembly 40, the printing assembly 140 may be removed as a unit to facilitate maintenance and repair or to print a different target pattern. As shown in FIG. 9, the printing assembly 140 may be configured as a printing cartridge having various rollers mounted between spaced side plates 142. The rollers include, in the direction of paper web feed 141, an inking roller 144, a printing roller 148 and a clamping roller 150.

The inking roller 144 is rotatably mounted to one end of the side plates 142 via a shaft 153. The inking roller 144 includes an inkpad sleeve 145 to hold a desired amount of ink. The ink may be supplied to the inkpad sleeve 145 through ink fill holes 147 on the protective cover 146. The cover 146 surrounds the inking roller 144 to protect the same from the environment while helping to prevent undesirable ink spills.

The printing roller 148 is disposed adjacent the inking roller 144 and rotatably mounted to the side plates 142 via a corresponding shaft 166. The printing roller 148 includes at least one printing pad or stamp 149 in the shape and pattern of the desired target. In the current embodiment, the target pattern includes a pair of donut shapes and a dot. However, various other patterns and shapes such as animals and geometric configurations may also be used. The inking roller 144 is biased against the printing roller 148 to insure a sufficient amount of ink is transferred to the stamp(s) 149 for printing onto the web.

The clamping roller 150 is disposed above the printing roller 148 and rotatably mounted to the side plates 142 via a corresponding shaft 161. The clamping roller 150 and the printing roller 148 form a nip therebetween. The clamping roller 150 is also biased against the printing roller 148 so that the web is pressed against the stamp(s) 149 as the web passes through the nip to obtain the printed target T.

To bias the inking roller 144 and the clamping roller 150 against the printing roller 148, each side plate 142 includes respective biasing mechanisms therein. As shown in FIG. 9, the side plate 142 includes a first recess 152 having a bore (not shown) supporting one end of the shaft 153. The bore is preferably configured to allow some play of the shaft 153. That shaft end includes an annular disc 154 anchoring the shaft end to the side plate 142. A spring clip 156 is disposed adjacent the annular disc 154 and acts thereon to press the inking roller 144 against the printing roller 148. A corresponding second recess 158 is formed on the side plate 142 for the clamping roller 150.

The second recess 158 also includes a bore configured to support and allow some play of one end of the shaft 161. That shaft end includes an annular disc 160 anchoring the shaft end to the side plate 142. A spring clip 162 is disposed adjacent the annular disc 160 and acts thereon to press the clamping roller 150 against the printing roller 148. Due to the spring clips 156 and 162 acting on the respective rotating annular discs 154 and 160, the discs 154 and 160 are preferably made from durable plastic that permits smooth rolling contact with the spring clips 156 and 162. Other materials such as wood and metal with similar characteristics may also be employed. Moreover, other springs (such as coil springs, elastomeric blocks, biased pins, etc.) may be employed in place of the spring clips 156 and 162.

Figure 10:
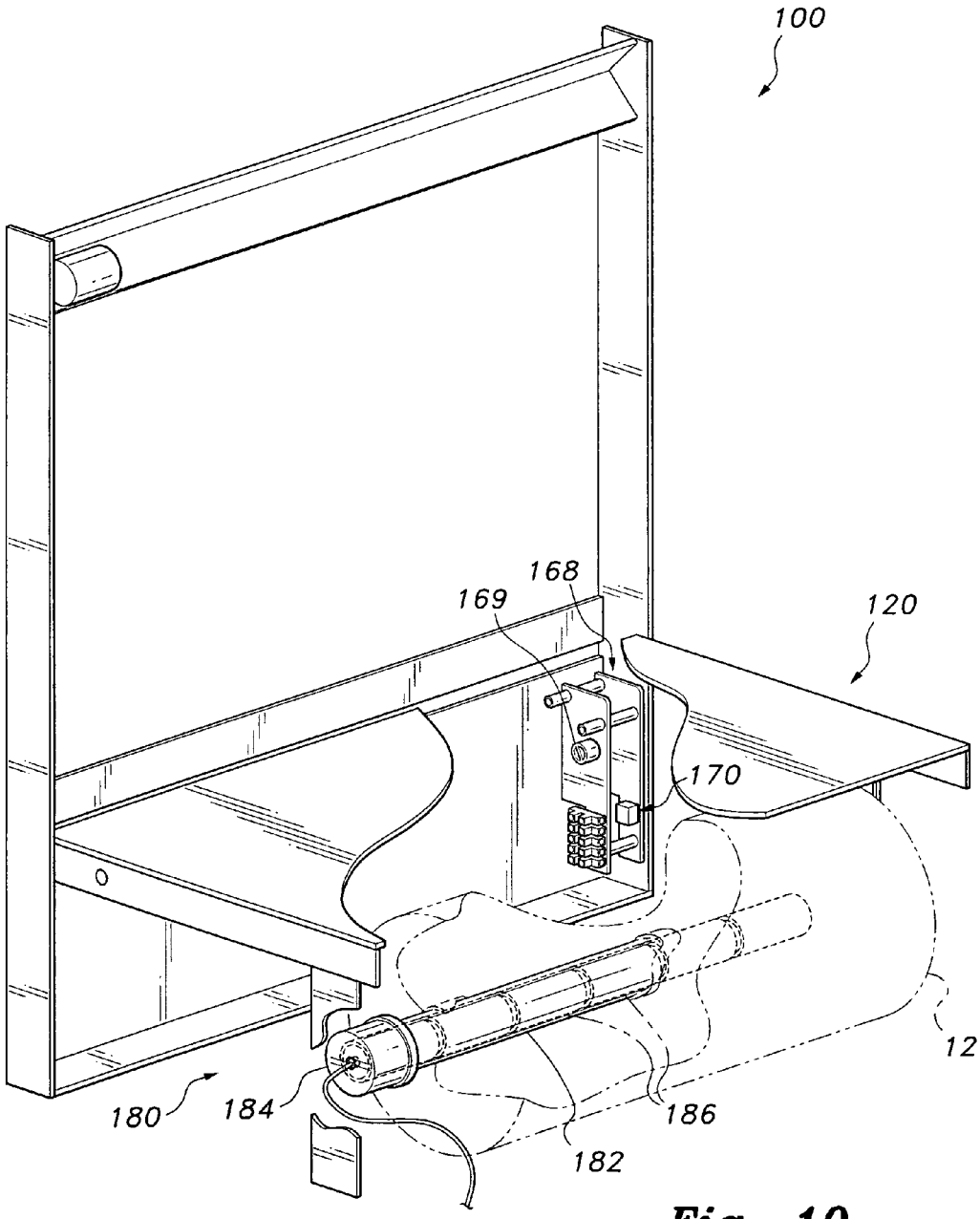
FIG. 10 is a partial perspective view of the rolling target device of FIG. 7, the base being broken away to show the drive and control mechanism for the printing cartridge and the power source.

To drive the rollers 144, 148, 150, the rolling target device 100 includes a motor 168 mounted to one of the legs 132 as shown in FIG. 10. A drive shaft 169 extends from the motor 168 and includes a female, splined end. The female, splined end is adapted to mate with one end of the shaft 166 for the printing roller 148. This end of the shaft 166 includes a corresponding male, splined connection for the drive shaft 169. To facilitate the connection between the drive shaft 169 and the shaft 166, the side plate 142 includes a third recess 164, which supports the shaft 166 and accommodates or receives the drive shaft 169 therein. The other side plate 142 may also include the third recess 164. A control means 170 selectively operates the motor 168 as well as other functions such as powering the device 100, rate of feed, etc. Thus, once the printing assembly 140 is attached to the motor 168, activation thereof via the control mechanism 170 drives or rotates the printing roller 148. This in turn rotates the inking roller 144 and the clamping roller 150 due to the frictional engagement with each other. As an alternative, at least the inking roller 144 and the printing roller 148 may include meshing gears to facilitate concurrent rotation of both rollers for more positive driving in the printing process.

The power for the motor 168 may be supplied by a battery pack 180. The battery pack 180 is configured to function as a support bar for the supply roll 12, and as such, the battery pack 180 is mounted to the support legs 122 via clamps similar to the clamps 24. The battery pack 180 includes an elongate, cylindrical tube 182 having an open end and a closed end. A plurality of batteries 186 may be housed inside the tube 182. The open end is covered by an end cap 184. Both the closed end and the end cap 184 function as electrode ends when assembled with the batteries, and the generated electricity is transmitted to the control mechanism 170 via wires.

Thus, the alternative rolling target device 100 includes many features enhancing convenience and functionality. The foldable frame permits the rolling target device 100 to be carried and stored easily, and the printing assembly 140, configured as a cartridge, permits a plurality of cartridges with a respective, differently patterned targets to be interchangeably mounted to the rolling target device 100. The battery pack 180 replaces the support bar 13 of the previous embodiment, which eliminates the necessity of an additional bulky housing for the batteries, thus preserving simplicity of construction and form.

It is noted that the rolling target devices 10 and 100 encompass a variety of alternatives. For example, the rolling target device 10, 100 is preferably made from steel, but other durable and impact resistant materials may be used instead. The control means 40, 170 may include a digital programmable control to control the rate and/or amount of targets to be printed. The rolling target device 10, 100 may also include various colors and indicia for advertising, manufacturing and/or personal information.

It is to be understood that the present invention is not limited to the embodiments described above, but encompasses any and all embodiments within the scope of the following claims.

I claim:

1. A rolling target device, comprising:

a base having opposing ends, a planar top panel, and a pair of support legs extending down from one of the ends of the base;

a supply roll clamping assembly for holding a supply roll of paper, the supply roll clamping assembly being disposed on the base;

a target window frame disposed on the end of the base opposite the support legs, the target window frame having an opening for displaying a printed target and a barrier wall, the planar top panel extending towards the barrier wall to form a gap between the planar top panel and the barrier wall, the gap allowing passage of a web of material from the supply roll;

a selectively operable printing assembly mounted under the top panel of the base for selectively printing targets of various patterns on the web, the barrier wall shielding the printing assembly from projectiles;

a selectively operable web feeding assembly positively feeding the web through the printing assembly and the opening of the target window frame to selectively display the printed target; and a control assembly connected to the printing assembly and the web feeding assembly for feeding and printing the web of material.

2. The rolling target device of claim 1, wherein said supply roll of paper comprises a roll of paper towels.

3. The rolling target device of claim 1, wherein said supply roll of paper comprises a roll of toilet paper.

4. The rolling target device of claim 1, wherein said target window frame comprises a substantially rectangular framework having spaced, upstanding legs and a cross cover disposed between the upstanding legs at the top of the upstanding legs, the cross cover providing a protective barrier for said web feeding assembly.

5. The rolling target device of claim 1, wherein supply roll clamping assembly comprises a C-clamp mounted to each of the legs of said base.

6. The rolling target device of claim 5, wherein said base is rigidly attached to said target window frame.

7. The rolling target device of claim 5, wherein said base is pivotally attached to said target window frame, said base being selectively foldable into said target window frame.

8. The rolling target device of claim 1, wherein said web feeding assembly comprises a pair of feed rollers and a feed motor operatively connected to said feed rollers, and an idle roller adjacent the gap, said web being wound around the idle roller through the gap towards the feed, selective operation of said feed motor positively feeding said web through said printing assembly and said window.

9. The rolling target device of claim 1, wherein said printing assembly is disposed in said base, said printing assembly comprising:

a selectively actuated, elongated printing platen, the printing platen being pivotally mounted at one end;

at least one stamp attached to the printing platen, the at least one stamp having a desired target pattern;

at least one spring attached to the printing platen at the end opposite the pivotal mounting, the spring biasing the printing platen into a raised position;

a support platen disposed apart from said printing platen, the support platen having an inkpad; and a cam drive for impacting the printing platen as said web is being fed between the printing platen and the support platen to thereby print the desired target pattern onto said web.

10. The rolling target device of claim 9, wherein further comprising a plurality of tensioned fasteners detachably mounted the support platen to said base to provide access to said inkpad for recharging, the tensioned fasteners also absorbing impact from the printing platen.

11. The rolling target device of claim 9, wherein said cam drive comprises a motor, a rotatable printing cam, and a belt interconnecting the motor and the printing cam, selective operation of the motor rotating the printing cam to impact upon an upper side of said printing platen and print the desired target pattern on said web during each full cycle of said printing cam.

12. The rolling target device of claim 1, wherein said printing assembly comprises at least one cartridge detachably mounted to said target window frame.

13. The rolling target device of claim 12, wherein said at least one cartridge comprises a plurality of interchangeable cartridges, each of the cartridges being capable of printing a different target pattern.

14. The rolling target device of claim 12, wherein said at least one cartridge comprises:

a pair of spaced side plates, one of the side plates being adapted for mounting to said target window frame;

an inking roller rotatably mounted between the side plates at one end of the side plates, the inking roller having an inkpad sleeve thereon;

a cover detachably mounted to the side plates, the cover covering the inking roller and having at least two ink fill holes for charging the inkpad sleeve;

a printing roller rotatably mounted between the side plates adjacent the inking roller, the printing roller having at least one stamp thereon in a pattern for the desired target, the at least one stamp being charged with ink as said printing roller rotates against the inking roller; and a clamping roller rotatably mounted between the side plates adjacent the printing roller, the clamping roller and the printing roller forming a nip, the printing roller printing the desired target pattern on said web as said web passes through the nip.

15. The rolling target device of claim 14, wherein each said side plate comprises a first biasing assembly for biasing said inking roller against said printing roller and a second biasing assembly for biasing said clamping roller against said printing roller.

16. The rolling target device of claim 15, wherein said first biasing assembly for biasing said inking roller comprises a first recess having a spring and an annular disc attached to a shaft end on said inking roller, the spring acting against the annular disc to press said inking roller against said printing roller.

17. The rolling target device of claim 16, wherein said second biasing assembly for biasing said clamping roller comprises a second recess having a spring and an annular disc attached to a shaft end on said clamping roller, the spring acting against the annular disc to press said clamping roller against said printing roller.

18. The rolling target device of claim 17, wherein said printing roller includes a shaft having a male, splined end and said target window frame framework has spaced, upstanding legs, said target window frame further comprising a motor for selectively driving said printing roller, the motor being attached to one of the upstanding legs, the motor having an output shaft having a female, splined end, the male and female splined ends forming a detachable connection for said at least one cartridge.

19. The rolling target device of claim 1, further comprising a battery pack mounted to said supply roll holding assembly, said battery pack providing power for the control assembly and serving as a support bar for said supply roll of paper.

20. The rolling target device of claim 19, wherein said battery pack comprises an elongate cylindrical tube having an open end and a closed end, a plurality of batteries disposed inside the cylindrical tube, and an end cap disposed on the open end, the end cap and the closed end defining electrodes for transmitting power to said control assembly.

* * * * *